US007700896B2

(12) United States Patent
Watanabe et al.

(10) Patent No.: US 7,700,896 B2
(45) Date of Patent: Apr. 20, 2010

(54) IMAGE HEATING DEVICE USING INDUCTION HEATING SYSTEM

(75) Inventors: Koki Watanabe, Moriya (JP); Shouhei Takeda, Toride (JP); Shinichiro Wakahara, Katsushika-ku (JP); Jiro Shirakata, Kashiwa (JP); Koji Takematsu, Abiko (JP); Koichiro Nishimura, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 515 days.

(21) Appl. No.: 11/764,630

(22) Filed: Jun. 18, 2007

(65) Prior Publication Data

US 2007/0295707 A1 Dec. 27, 2007

(30) Foreign Application Priority Data

Jun. 22, 2006 (JP) ..... 2006-172719

(51) Int. Cl.
*H05B 6/14* (2006.01)
*G03G 15/20* (2006.01)

(52) U.S. Cl. ..... 219/216; 219/619; 219/649; 219/676; 399/328; 399/329; 399/334

(58) Field of Classification Search ..... None
See application file for complete search history.

(56) References Cited

U.S. PATENT DOCUMENTS

| | | | | |
|---|---|---|---|---|
| 7,271,371 | B2 * | 9/2007 | Takematsu et al. | 219/619 |
| 7,462,804 | B2 * | 12/2008 | Shirakata et al. | 219/619 |
| 2005/0207805 | A1 | 9/2005 | Tsueda | |
| 2006/0086722 | A1 | 4/2006 | Takematsu | |

FOREIGN PATENT DOCUMENTS

| | | | |
|---|---|---|---|
| JP | 04-264479 | A | 9/1992 |
| JP | 05-009027 | A | 1/1993 |
| JP | 2000-162912 | | 6/2000 |
| JP | 2005-208623 | | 8/2005 |
| JP | 2005-221575 | | 8/2005 |
| WO | 2005062133 | | 7/2005 |

* cited by examiner

*Primary Examiner*—Joseph M Pelham
(74) *Attorney, Agent, or Firm*—Canon USA Inc IP Div.

(57) ABSTRACT

An image heating member includes a first region having a Curie temperature higher than a preset temperature, and a second region having a Curie temperature lower than the Curie temperature of the first region. A width of the first region in a conveying direction of a recording material is equal to or larger than a width of the recording material of a maximum size to be fed. The second region is provided outside the first region.

6 Claims, 6 Drawing Sheets

IMAGE HEATING DEVICE USING INDUCTION HEATING SYSTEM

BACKGROUND OF THE INVENTION

1. Field of the Invention

The present invention relates to an image heating device using an induction heating system for a device using an electrophotography process, such as an electrophotography copier, an electrostatic printer, or a facsimile.

2. Description of the Related Art

Fixers that fix images to recording materials have been widely used. Such a fixer includes a heating roller having a cylindrical core metal and a release layer provided on the surface of the core metal, and a pressure roller having an elastic layer to press the heating roller. The fixer fixes a toner image to a recording material passing through a nip by heat and pressure with the surface temperature of the heating roller held at a predetermined fixing temperature.

A known example of the heating system of such a heating roller is that a halogen lamp is inserted into the heating roller, and the halogen lamp is turned ON and OFF for holding the temperature of the heating roller at the fixing temperature.

However, with this system, a long rise time is necessary from that the power of the device body is tuned ON to that the surface temperature of the heating roller of the fixer reaches a predetermined fixing temperature.

In addition, since the heat of the halogen lamp indirectly heats the heating roller, the power consumption tends to be increased.

In recent years, a fixer using the induction heating system has been developed. With this heating system, since a fixing roller generates heat due to magnetic flux, the rise time and the heat exchange efficiency are advantageous as compared with those of the halogen system.

For example, a configuration is disclosed in Japanese Patent Publication No. 5-9027. With the configuration, when a high frequency voltage is applied, a coil generates magnetic flux, and a core metal portion of a heating roller made of magnetic ferrous metal generates heat due to the magnetic flux.

Another configuration is disclosed in Japanese Patent No. 02975435 using the induction heating system. With the configuration, the heating roller core metal has a Curie temperature which is almost equal to the fixing temperature. When the temperature of the heating roller core metal reaches the Curie temperature, the core metal loses the magnetic property. Accordingly, the magnetic portion is not increased in temperature, and hence, the magnetic portion can be held at a uniform fixing temperature.

In addition, a coil that defines the heating region has a width larger than the width of a recording material of the maximum size so as to provide the reliable fixing temperature at the edges of the recording material of the maximum size.

However, by determining the width of the coil as described above, regions outside the area corresponding to the width of the recording material of the maximum size are also heated. As a result, resin components such as a gear, and electric components disposed at the end portions of the fixing roller may be heated. This may cause these components to be deteriorated.

SUMMARY OF THE INVENTION

The present invention provides an image heating device capable of suppressing defective fixing due to decrease in temperature of end portions of a sheet-passing region even when a plurality of recording materials of the maximum size are continuously heated, and also capable of decreasing the influence of the heat applied to components disposed in the vicinity of end portions of an image heating member even when a region of the image heating member not occupied by the sheet-passing region generates heat.

In particular, an image heating device includes: a coil that generates magnetic flux; and an image heating member having a first region and a second region, the image heating member generating heat due to the magnetic flux of the coil to heat an image formed on a recording material, the first region having a Curie temperature equal to or higher than a first temperature and having a width equal to or larger than that of the recording material of a maximum size to be fed in a direction orthogonal to a conveying direction of the recording material, the second region being provided outside the first region and having a Curie temperature lower than the first temperature.

Further features of the present invention will become apparent from the following description of exemplary embodiments with reference to the attached drawings.

DESCRIPTION OF THE EMBODIMENTS

An embodiment of the present invention is described below with reference to the attached drawings.

Figure 1:
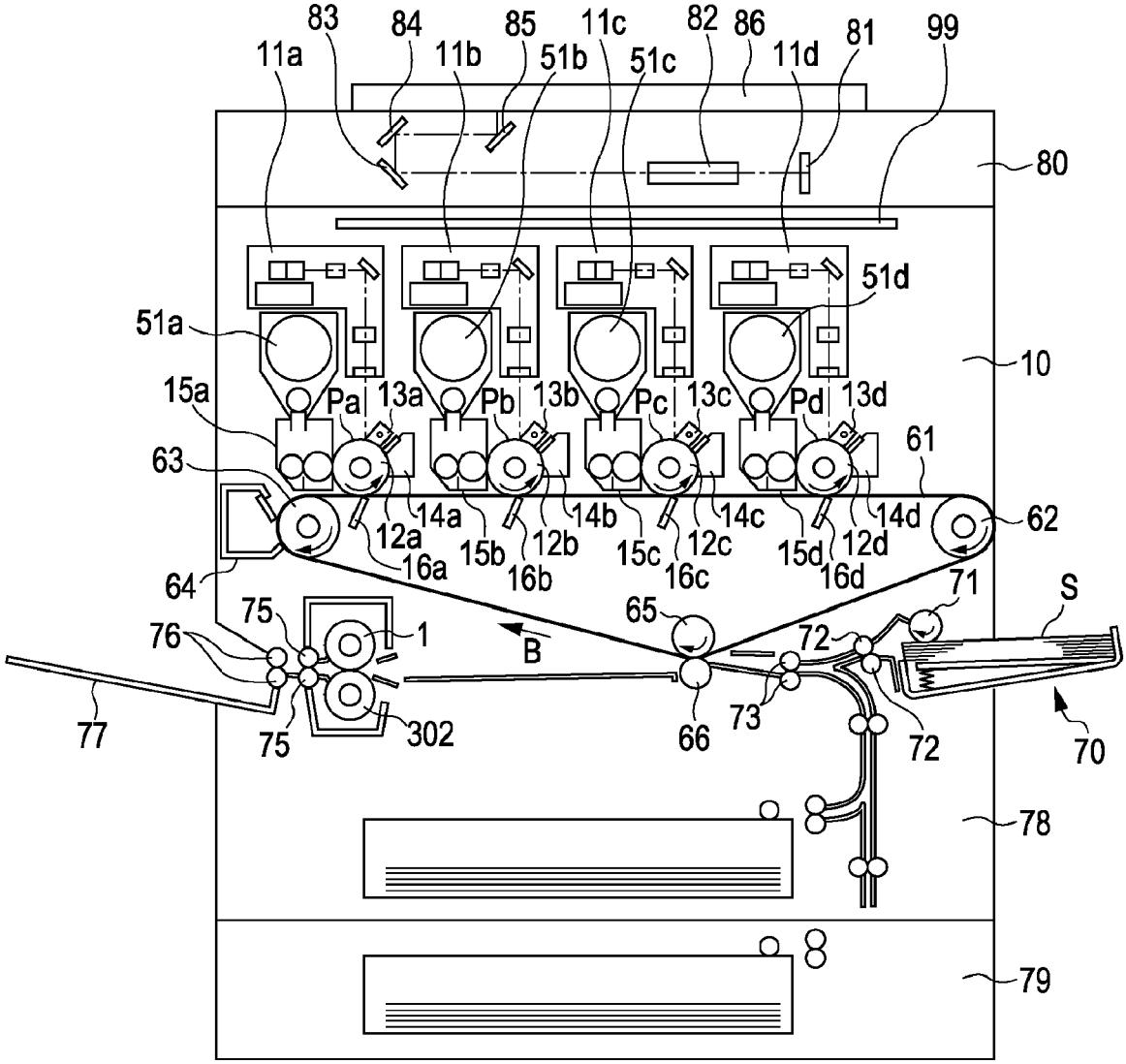
FIG. 1 is a schematic illustration showing an image forming apparatus according to an embodiment.

First, an image forming apparatus using an image heating device according to the embodiment of the present invention is described with reference to FIG. 1. FIG. 1 is a schematic illustration showing a digital full color copier provided with the image heating device according to the embodiment of the present invention. The copy operation of the digital full color copier is described with reference to FIG. 1. In the drawing, the reference numeral 80 denotes an original document reading section and 10 denotes a full color image forming section. First to fourth image stations Pa to Pd are provided in the full color image forming section 10. The image forming stations Pa to Pd have photosensitive drums 12*a* to 12*d*, respectively, as image bearing members.

In addition, dedicated charging units 13*a* to 13*d* and laser scanning units 11*a* to 11*d* are provided at the peripheries of the photosensitive drums 12*a* to 12*d*, respectively. The laser scanning units 11*a* to 11*d* emit light on the photosensitive drums 12*a* to 12*d* in accordance with image information. Developing units 15*a* to 15*d* develop formed electrostatic latent images. Drum cleaning units 14*a* to 14*d* remove toner remained on the photosensitive drums 12*a* to 12*d* after the transfer operation. Transfer units 16*a* to 16*d* transfer the toner images formed on the photosensitive drums 12*a* to 12*d* to an intermediate transfer body or a recording material. Also, cylindrical toner cartridges 51*a* to 51*d* are disposed directly below horizontal portions and along vertical portions of the laser scanning units 11*a* to 11*d*. The toner cartridges 51*a* to 51*d* correspond to the developing units 14*a* to 14*d*, respectively. The toner cartridges 51*a* to 51*d* are detachably attached for supplement of toner. The image forming stations Pa to Pd form a cyan image, a magenta image, a yellow image, and a black image, respectively.

An endless intermediate transfer belt 61 is disposed below the photosensitive drums 12*a* to 12*d* in a manner passing through the image forming stations Pa to Pd.

The intermediate transfer belt 61 extends over a driving roller 62 and driven rollers 63 and 65. A cleaning unit 64 is provided for cleaning the surface of the intermediate transfer belt 61.

With the above configuration, an electrostatic latent image is formed on the photosensitive drum 12*a* by charging of a charging unit 13*a* of the first image forming station Pa and exposure of the laser scanning unit 11*a*. The developing unit 15*a* visualizes the electrostatic latent image as a cyan toner image by using a developing agent containing cyan toner. The transfer unit 16*a* transfers the cyan toner image on the surface of the intermediate transfer belt 61.

While the cyan toner image is transferred on the intermediate transfer belt 61, a magenta toner image is formed in the second image forming station Pb in a manner similar to the cyan toner image. The transfer unit 16*b* superposes the magenta toner image accurately on the cyan toner image of the intermediate transfer belt 61 that has completed the former transfer of the first image forming station Pa.

Yellow and black images are formed in a manner similar to the former color images. Thus, the four toner images are superposed on the intermediate transfer belt 61. A secondary transfer roller 66 transfers (secondarily transfers) the four color toner images that have been formed on the intermediate transfer belt 61, on a recording material S that is stored in a sheet feeding cassette 70 and conveyed by a sheet feeding roller 71, a conveying roller pair 72, and a registration roller pair 73, in an appropriate timing. The recording material S with the secondary transfer completed is heated so that the transferred toner images are fixed to the recording material S by a fixing roller pair 74. Accordingly, a full color image can be formed on the recording material S.

The cleaning units 14*a* to 14*d* remove the remaining toner from the photosensitive drums 12*a* to 12*d* after the transfer is completed, to prepare the next image formation.

Figure 2:
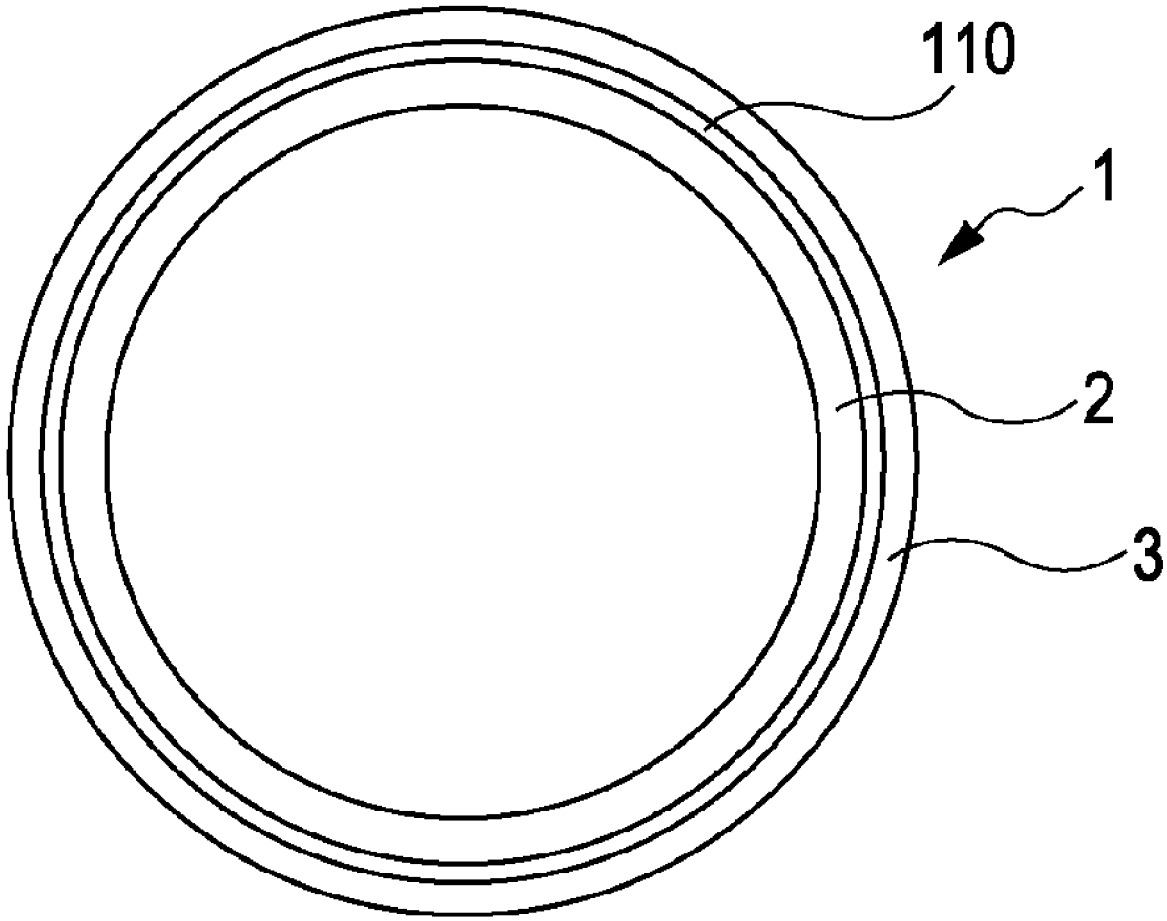
FIG. 2 is a cross-sectional view showing a heating roller of the embodiment.

Next, the structure of the cross section of a heating roller 1 (image heating member) is described below with reference to FIG. 2.

A heating roller core metal 2 made of ferrous metal is a conductive layer of the heating roller 1. Typically, to make a thin heating roller core metal 2, ends of a plate are welded to be a cylinder, the cylinder is stretched and polished, and formed in a predetermined shape. In the present embodiment, a heating roller longitudinal center core metal portion 5 (hereinafter, referred to as a center core metal portion) as a first region, and a heating roller longitudinal end core metal portion 6 (hereinafter, referred to as an end core metal portion) as a second region, are made in the above-mentioned processing manner.

The center core metal portion 5 and the end core metal portion 6 are made of ferrous metal, but have different Curie temperatures.

In general, a Curie temperature may be changed by varying the chemical composition of the base metal. In this embodiment, the Curie temperature is changed by varying the composition amount of nickel (Ni) mainly contained in the ferrous metal.

Figure 4:
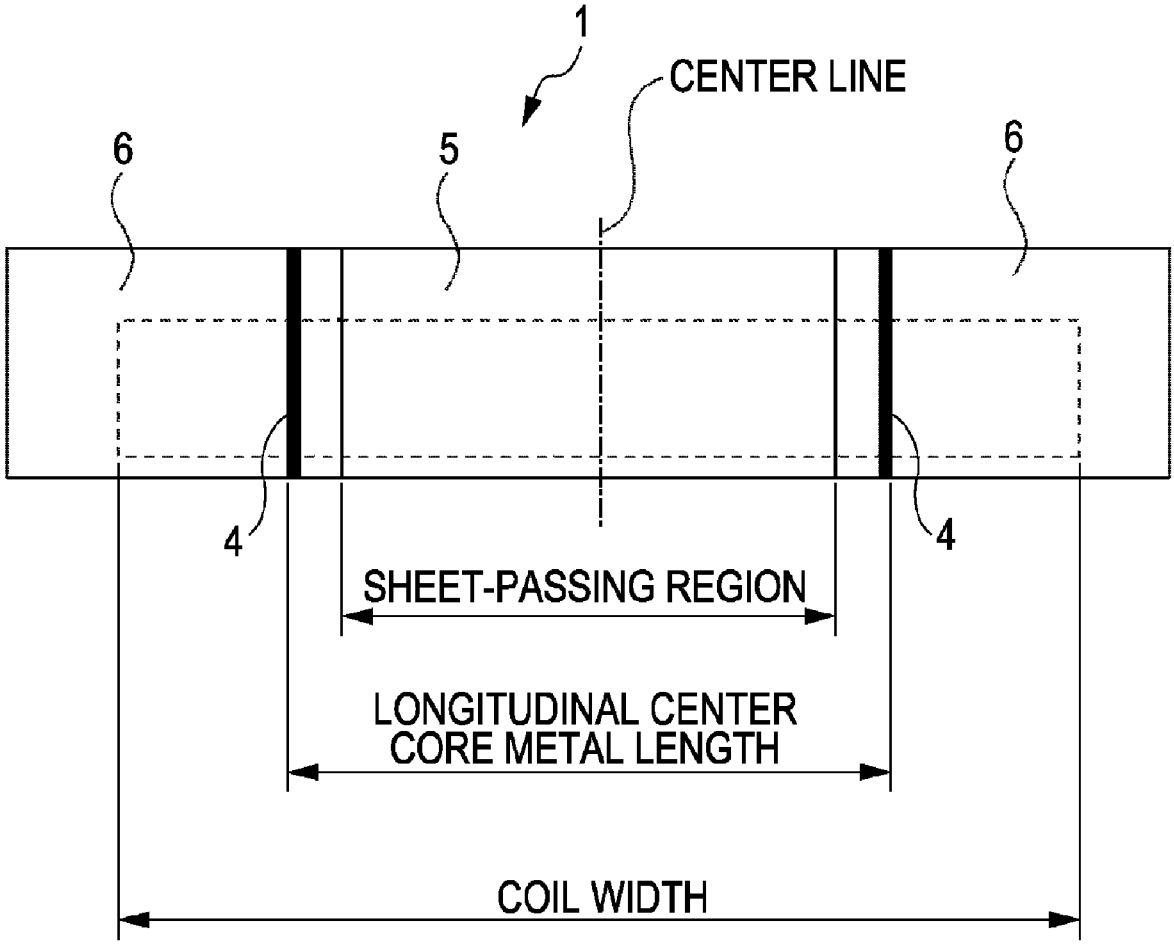
FIG. 4 is a longitudinal cross section showing the heating roller of the embodiment.

As shown in FIG. 4, the center core metal portion 5 has a width larger than the width of a sheet-passing region of the recording material of the maximum size to be fed in a direction orthogonal to a conveying direction of the recording material. The width of the center core metal portion 5 may be equal to the width of the sheet-passing region; however, the width may be larger than the sheet-passing region so as to provide reliable fixing performance at the end portions of the sheet-passing region. The end core metal portion 6 is provided outside the center core metal portion 5 at each end thereof. In this embodiment, the end core metal portions 6 provided at both ends have the same composition amount of Ni mainly contained in the ferrous metal, so as to have the same Curie temperature. Since the end core metal portions 6 at both ends have the same Curie temperature, the temperature of both end portions can be prevented from being unevenly distributed and affecting the sheet-passing region. The Curie temperatures of both end portions may differ due to a variation in the composition amounts of Ni. In such a case, the following conditions may be satisfied to suppress the unevenness of an image caused by the difference in the temperatures of the end portions of the sheet-passing region.

As described above, in the case where the second regions are provided at both ends of the first region, the following conditions are satisfied:

$$0^\circ\ \text{C.} \leqq |TQe1 - TQe2| \leqq 10^\circ\ \text{C.},$$

and more particularly, $$0^\circ\ \text{C.} \leqq |TQe1 - TQe2| \leqq 5^\circ\ \text{C.},$$

where TQe1 is a Curie temperature of the second region at one end, and TQe2 is a Curie temperature of the second region at another end.

The Curie temperature TQe1 of the end core metal portion 6 is adjusted to be 100° C. TQe1 is a temperature lower than 180° C. which is an image heating temperature (described below), namely, a preset temperature for heating an image. A Curie temperature TQc of the center core metal portion 5 is adjusted to be 200° C. The Curie temperature TQc is set to be lower than an allowable temperature limit for the image heating device, i.e., an allowable temperature limit for the coating of the coil in this embodiment, with regard to a temperature rise of an area not occupied by the sheet-passing region. TQc is a temperature higher than 180° C. which is the image heating temperature. If TQc is equal to or lower than the image heating temperature, then the magnetic permeability given around the image heating temperature may be small, and this may decrease heating efficiency.

Connection portions 4 of both ends of the center core metal portion 5 with respect to the respective ends of the end core metal portions 6 are processed by welding in a manner similar to the cylinder-forming process as described above.

Then, the product is stretched and polished similarly, and formed in a predetermined shape.

The center core metal portion 5 has the composition amount of Ni different from those of the end core metal portions 6, however, the center core metal portion 5 and the end core metal portions 6 are made of substantially the same ferrous metal. Thus, the weld strength of the center core metal portion 5 with respect to the end core metal portions 6 is not deteriorated. In the manner as described above, the heating roller core metal 2 is made.

A release layer 3 is provided on the outer periphery of the heating roller core metal 2. The release layer 3 is made of polytetrafluoroethylene (PTFE) for preventing melted unfixed toner from adhering on the heating roller core metal 2. The heating roller core metal 2 and the release layer 3 are coupled to each other with an adhesive 110 interposed therebetween as a binder layer.

Alternatively, a thin rubber layer may be provided between the release layer 3 and the heating roller core metal 2.

An exemplary measurement method of the Curie temperature is described below. In this embodiment, a B-H analyzer (model No.: SY-8232) manufactured by Iwatsu Test Instruments Corporation is used for the measurement. Predetermined first and second coils of the measurement device are wound around a part of a fixing roller as a measurement sample, and the fixing roller is measured with the frequency of 20 kHz. The shape of the measurement sample is not limited particularly as long as the coils can be wound. (The absolute value of the magnetic permeability may vary when the shape varies, however, almost no change is found in the Curie temperature.)

After the coils are set on the sample, the sample is placed in a temperature-controlled room and the temperature is saturated. Then the magnetic permeability at the temperature is plotted. By varying the temperature of the temperature-controlled room, a temperature dependence curve of the magnetic permeability can be obtained. At this time, the temperature, at which the magnetic permeability is 1, is determined as the Curie temperature. In particular, the temperature, at which the magnetic permeability is 1, is obtained as follows. As the temperature of the temperature-controlled room is increased, the variation in the magnetic permeability is stopped at a certain point. The point is assumed as the temperature at which the magnetic permeability is 1, namely, the Curie temperature.

Next, the relationship among the width of the coil of the heating roller 1 in the longitudinal direction, the width of the recording material of the maximum size to be fed, and the length of the center core metal portion 5, is described with reference to FIG. 4. Note that the recording material of the maximum size to be fed is a recording material of a size written in the specification or the like of the image forming apparatus. In the present embodiment, the relationship is established that the coil width>the length of center core metal portion>the width of the sheet-passing region. Since the coil width and the length of the center core metal portion 5 are larger than the width of the sheet-passing region, the uneven distribution of the temperatures between the end portions of the sheet-passing region can be prevented. In addition, although the coil width is large, the length of the center core metal portion 5 is smaller than the coil width. Accordingly, even if the end core metal portion 6 generates heat due to the coil, the temperature is not increased markedly because the Curie temperature thereof is relatively low.

To be more specific, since the maximum dimension of the sheet-passing region in this embodiment is 305 mm, the width of the sheet-passing region is increased at both ends by 5 mm each so as to heat the end portions sufficiently. As a result, the length of the center core metal portion 5 is determined to 315 mm in total. The coil width is increased at both ends by 5 mm each, and determined to 325 mm. In this embodiment, various sizes of sheets can pass through the sheet-passing region as long as the width of the recording material is equal to or smaller than the width of the sheet-passing region. Even when the size of the sheet is changed, the sheet-passing region is designed such that the center portion of the sheet constantly passes through the same point (center reference).

Figure 3:
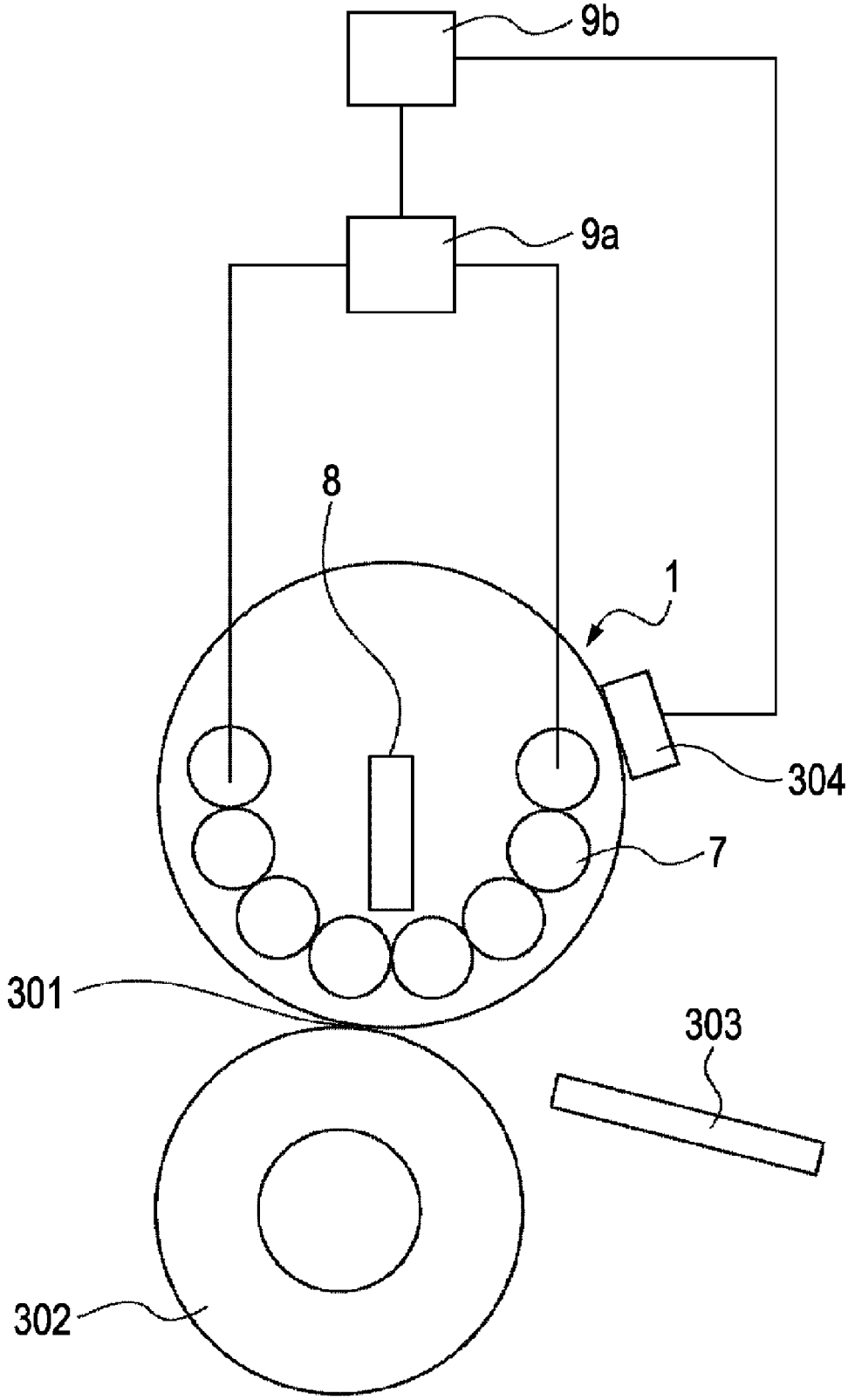
FIG. 3 is a cross-sectional view showing a fixer of the embodiment.

Next, the relationship between an induction heating material and the heating roller 1 is described below with reference to FIG. 3.

The heating roller 1 as an induction heating material generates heat by electromagnetic induction.

To generate heat at the heating roller 1, a magnetic flux generating unit (coil unit) including an exciting coil 7 and a magnetic material core 8 is disposed in the heating roller 1. A high frequency power source 9*a* applies a high frequency alternating voltage to the exciting coil 7. Also, a thermistor 304 is mounted to the heating roller 1, as a temperature detecting member that detects the temperature of the surface of the heating roller 1. The output of the thermistor 304 is transmitted to a control section 9*b* such as a CPU, and the control section 9*b* controls power distribution to the coil so that the surface temperature of the heating roller 1 becomes the preset temperature for heating an image, namely, 180° C. in this embodiment. In this embodiment, a power distribution controlling unit has the high frequency power source 9*a* and the control section 9*b*. Accordingly, the magnetic flux generating unit generates the magnetic flux. This causes eddy current to be generated in the conductive layer of the heating roller 1, and the heating roller 1 generates heat. The power distribution controlling unit can hold the temperature of the heating roller 1 at the preset temperature.

In this embodiment, the fixer is used as the image heating device. A pressure roller 302 presses the heating roller 1. The pressure roller 302 is a pressing member that forms a nip 301 for nipping and conveying the recording material. The recording material is conveyed by a sheet feeding unit, and the recording material having the toner images transferred thereon enters the nip 301 through a fixing inlet guide 303. Then, the toner images formed on the recording material are fixed to the recording material by the heat and pressure. The pressure roller 302 of the present embodiment is formed such that an elastic layer is provided on a core metal made of iron, aluminum, or the like, and a release layer (surface layer) made of PTFE or the like is provided on the elastic layer.

Figure 6:
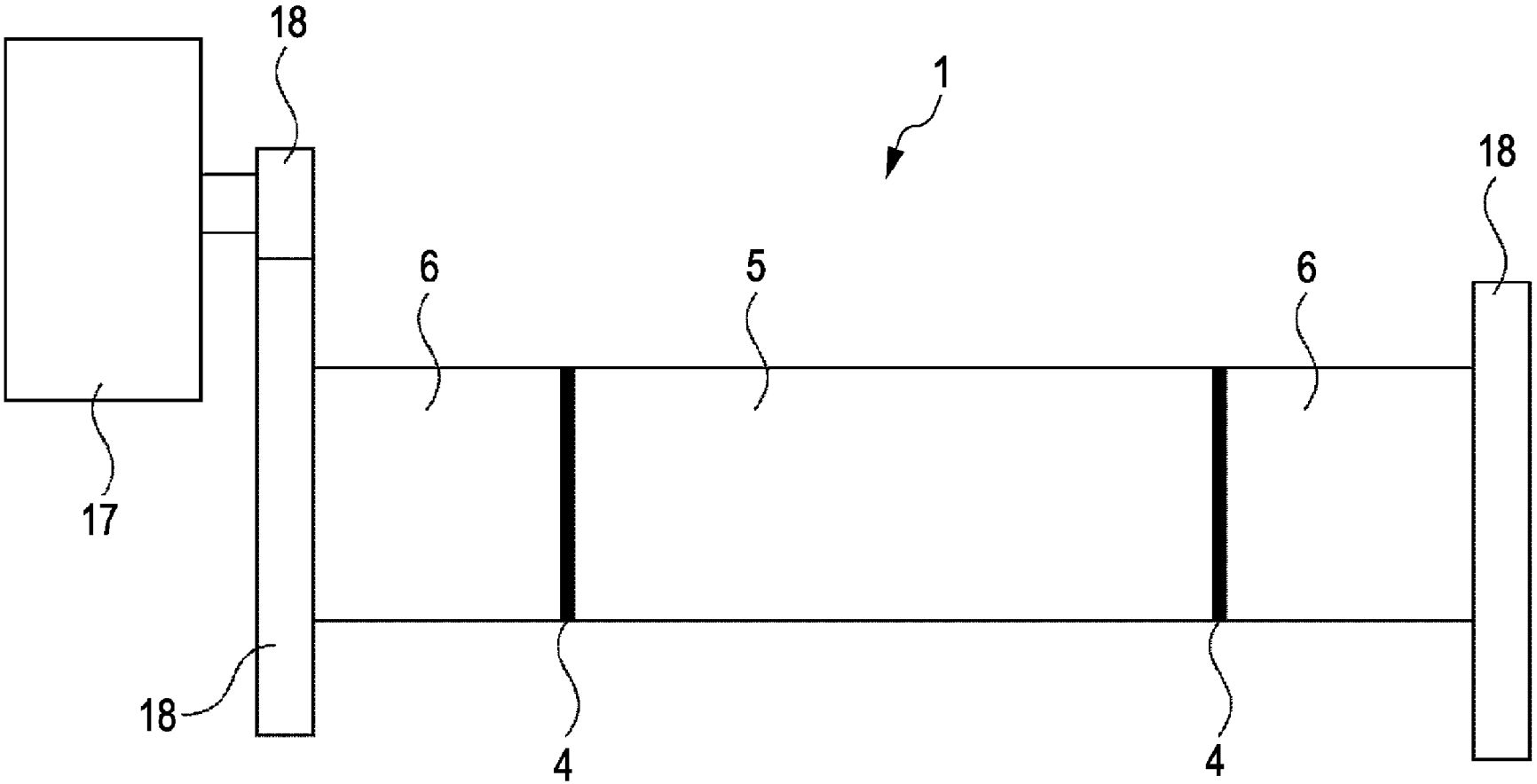
FIG. 6 is a side elevational view showing the fixer of the embodiment extending in a longitudinal direction.

The heating roller 1 is rotated using power generated by a motor 17 and transmitted through a heating roller gear 18, as shown in FIG. 6. The power from the heating roller gear 18 may be further transmitted to the heating roller 1, and the heating roller gear 18 provided on the other side, so as to drive another component.

The heating roller gear 18 connected to the heating roller 1 has been requested to have the allowable temperature limit of about 230° C. when employing the known halogen system. However, with the present invention, a resin material having the allowable temperature limit of 100° C. can be used. The advantage of the allowable temperature limit can be applied to a driving motor for the heating roller 1 as well as its peripheral electric components. In addition, the distance between the image heating device and those components can be decreased.

In this embodiment, while the material of the heating roller 1 is ferrous metal as an example, a ferromagnetic material (metal having a large magnetic permeability) may be used. For example, metal such as nickel or cobalt is suitable instead of the ferrous metal. By using such a ferromagnetic material, a larger quantity of the magnetic flux generated by the magnetic flux generating unit can be kept in the ferromagnetic metal, i.e., the magnetic flux density can be increased. Accordingly, the eddy current can be efficiently generated at the surface of the ferromagnetic metal, and hence, heat can be generated.

The manufacturing method of the heating roller 1 is not limited to that described above, and the following method may be used. Generally, the heating roller core metal 2 is manufactured by electroforming if the thickness of the heating roller core metal 2 is extremely small. For example, a metal material with a high purity, for instance, the Ni material in this embodiment is completely melted in an electric furnace, injected to a fireproof mold, and molded in a predetermined shape. In this embodiment, the center core metal portion 5 is coupled to the end core metal portions 6 by bonding.

Figure 5:
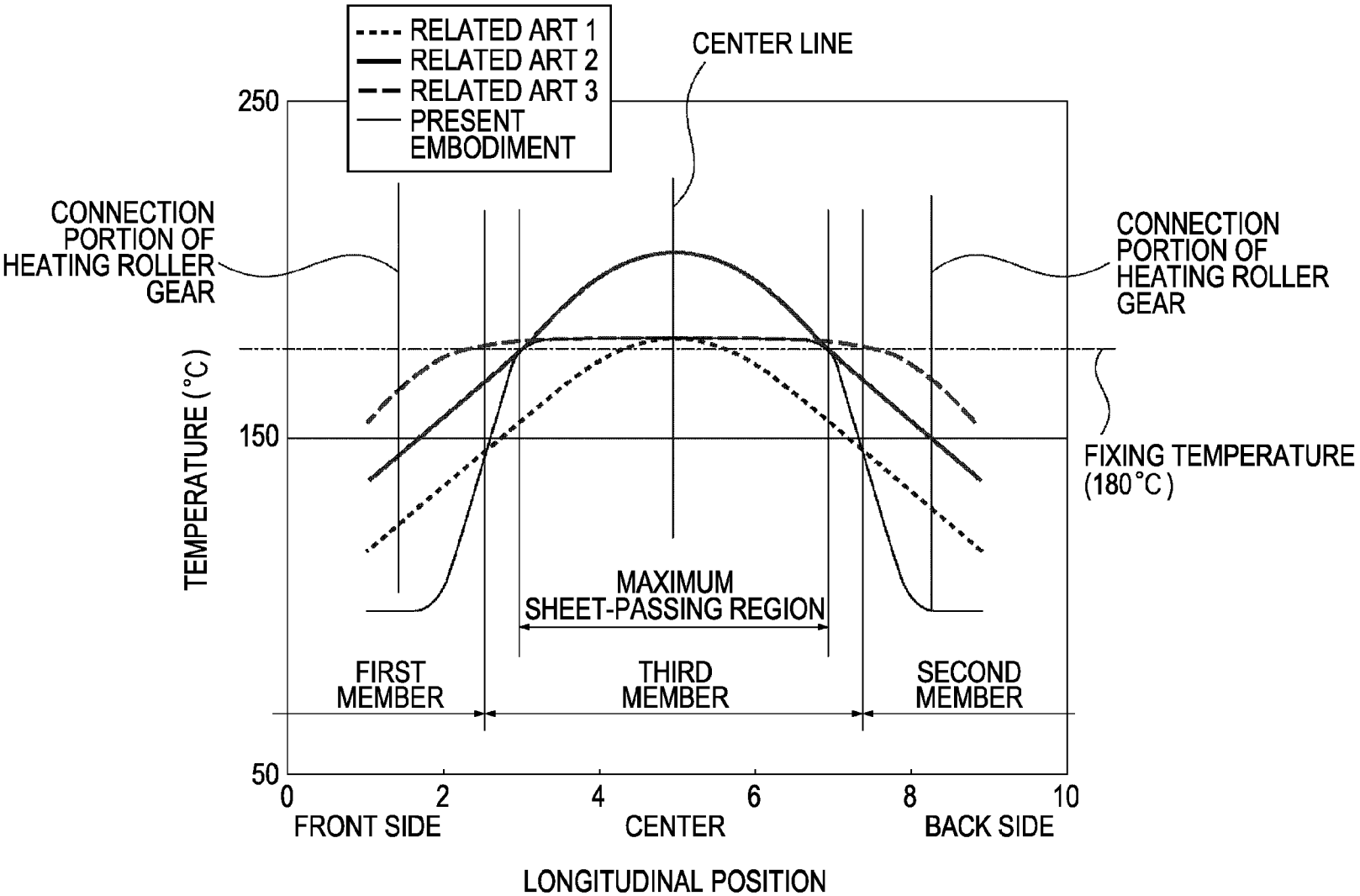
FIG. 5 is a graph showing the surface temperature of a fixing roller according to the embodiment and comparative examples.

Next, temperature distribution data of the present embodiment and comparative examples is shown in FIG. 5.

This is comparison data of the present invention with respect to Comparative Examples 1 to 3. Comparative Example 1 is the configuration disclosed in Japanese Patent No. 02975435, Comparative Example 2 is the configuration having a relatively high Curie temperature, and Comparative Example 3 is the configuration having a relatively large magnetic flux generating unit and a relatively large heating region. The lateral axis indicates the longitudinal position of the heating roller, and the vertical axis indicates the surface temperature of the heating roller at predetermined points.

CASE OF COMPARATIVE EXAMPLE 1

Referring to the result of the experiment, in the case of Comparative Example 1, if the temperature of the center portion is set to 180° C., the temperature of the maximum sheet-passing region is about 155° C., and consequently, the temperature is decreased, possibly causing defective fixing.

CASE OF COMPARATIVE EXAMPLE 2

If the temperature of the maximum sheet-passing region is held at 180° C., the temperature of the center portion is necessary to be 205° C., and consequently, the temperature is unnecessarily increased, possibly causing phenomenon called high temperature offset. The high temperature offset is phenomenon where excessively melted toner adheres on the fixing roller. This may cause dirt on the image of the next sheet.

CASE OF COMPARATIVE EXAMPLE 3

Since the magnetic flux generating unit and the heating region are relatively large, the temperature of the center portion and the temperature of the maximum sheet-passing region can be held at appropriate values. However, the temperature of the connection portion of the heating roller gear is increased to about 180° C. A resin material and electric components exhibiting sliding ability under the high-temperature environment may be extremely expensive, and thus may not satisfy the demand of cost reduction which is popular demand today. If the heating roller is mounted to a position where the temperature is sufficiently low as required for the present invention, then the size of the image forming apparatus becomes extremely large.

In the case of the present embodiment as compared with comparative examples described above, since the magnetic flux generating unit (coil) and the heating region are relatively large, the temperature of the center portion and the temperature of the maximum sheet-passing region can be held at appropriate values.

In addition, the temperature of the connection portion of the heating roller gear can be suppressed to about 100° C., a relatively inexpensive resin material and electric components can be used.

In the present embodiment, while the preset temperature is 180° C., if a plurality of preset temperatures are provided, the Curie temperature of the first region may be higher than the highest preset temperature. The Curie temperature of the second region may be lower than the lowest preset temperature.

While the end core metal portion 6 is used as the second region in the embodiment, a third region having a Curie temperature lower than that of the first region may be provided outside the first region.

With the present invention, even if the portions outside the sheet-passing region of the image heating member generate heat, the influence of the heat with respect to the components disposed in the vicinity of the end portions of the image heating member can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-172719 filed Jun. 22, 2006, which is hereby incorporated by reference herein in its entirety.

What is claimed is:

1. An image heating device comprising:

a coil that generates magnetic flux; and an image heating member having a first region and a second region, the image heating member generating heat due to the magnetic flux of the coil to heat an image formed on a recording material, the first region having a Curie temperature equal to or higher than a first temperature and having a width equal to or larger than that of the recording material of a maximum size to be fed in a direction orthogonal to a conveying direction of the recording material, the second region being provided outside the first region and having a Curie temperature lower than the first temperature.

2. The image heating device according to claim 1, wherein the first temperature is higher than a preset temperature for heating the image.

3. The image heating device according to claim 1, wherein the Curie temperature of the second region is lower than a preset temperature for heating the image.

4. The image heating device according to claim 1, wherein a width of the coil in the direction orthogonal to the conveying direction of the recording material is larger than the width of the first region.

5. The image heating device according to claim 1, wherein the second region is provided at each end of the first region.

6. The image heating device according to claim 1, wherein the second region is provided at each end of the first region, and the following conditions are satisfied, $$0° \text{ C.} \leqq |TQe1 - TQe2| \leqq 10° \text{ C.},$$

$$TQe1 < TQc, \text{ and}$$

$$TQe2 < TQc,$$

where TQe1 is a Curie temperature of the second region provided at one end, TQe2 is a Curie temperature of the second region provided at another end, and TQc is the Curie temperature of the first region.

* * * * *